US008789492B2

(12) United States Patent
Pape

(10) Patent No.: US 8,789,492 B2
(45) Date of Patent: Jul. 29, 2014

(54) COATING APPARATUS AND METHOD

(75) Inventor: James D. Pape, Columbia, PA (US)

(73) Assignee: AWI Licensing Company, Wilmington, DE (US)

( * ) Notice: Subject to any disclaimer, the term of this patent is extended or adjusted under 35 U.S.C. 154(b) by 1068 days.

(21) Appl. No.: 12/218,432

(22) Filed: Jul. 15, 2008

(65) Prior Publication Data

US 2010/0015346 A1 Jan. 21, 2010

(51) Int. Cl.
*B05B 7/00* (2006.01)
*B05D 1/28* (2006.01)

(52) U.S. Cl.
USPC ..... 118/300; 118/62; 118/63; 239/298

(58) Field of Classification Search
USPC ..... 118/300, 62, 63; 239/290, 296, 418, 239/398, 371, 298; 427/256, 420, 421, 424
See application file for complete search history.

(56) References Cited

U.S. PATENT DOCUMENTS

| | | | | |
|---|---|---|---|---|
| 2,286,924 | A | 6/1942 | Nicholson | |
| 2,703,760 | A | 3/1955 | Cunning | |
| 2,995,469 | A | 8/1961 | Le Claire | |
| 3,074,697 | A | 1/1963 | Friedell | |
| 3,359,941 | A | 12/1967 | Sible | |
| 3,516,849 | A | 6/1970 | Shank, Jr. et al. | |
| 3,885,066 | A | 5/1975 | Schwenninger | |
| 3,992,252 | A | 11/1976 | Coleman | |
| 4,008,121 | A | 2/1977 | Coleman | |
| 4,041,897 | A | 8/1977 | Ade | |
| 4,046,074 | A | 9/1977 | Hochberg et al. | |
| 4,075,976 | A | 2/1978 | Clayton | |
| 4,093,016 | A | 6/1978 | Coleman | |
| 4,128,667 | A | 12/1978 | Timson | |
| 4,197,812 | A | 4/1980 | Clayton | |
| 4,222,343 | A | 9/1980 | Zimmermann et al. | |
| 4,233,346 | A | 11/1980 | Kerkhofs | |
| 4,249,478 | A | 2/1981 | Gruener | |
| 4,342,423 | A | 8/1982 | Coleman | |
| 4,352,459 | A | 10/1982 | Berger et al. | |
| 4,355,762 | A | 10/1982 | Coleman | |
| 4,396,529 | A * | 8/1983 | Price et al. | 516/10 |

(Continued)

FOREIGN PATENT DOCUMENTS

| | | |
|---|---|---|
| DE | 101 29 247 A1 | 6/2002 |
| FR | 2 288 068 A1 | 5/1976 |
| FR | 2 586 413 A3 | 2/1987 |

OTHER PUBLICATIONS

"Towards Controlled Liquid Atomization", E.C. Fernandes, M.V. Heitor and V. Sivadas. Tenth Int. Symposium on Application of Laser Techniques to Fluid Mechanics. Jul. 10-13, 2000, Lisbon, Portugal.

(Continued)

*Primary Examiner* — Yewebdar Tadesse
(74) *Attorney, Agent, or Firm* — Amy M. Fernandez

(57) ABSTRACT

The invention is an alternative to a conventional atomizing coating apparatus. The apparatus and associated coating methodology of the invention provides a uniform atomized fluid stream, and, in turn, a uniform coating to an object on an industrial scale. The apparatus and methodology addresses many of the critical parameters associated with the conventional curtain and atomizing coating techniques, including but no limited to, uniform distribution, acoustical transparency, reduction or elimination of clogged nozzles, and elimination of the need for reciprocating nozzles.

5 Claims, 6 Drawing Sheets

(56) References Cited

U.S. PATENT DOCUMENTS

| | | | | |
|---|---|---|---|---|
| 4,448,818 | A | | 5/1984 | Hartog et al. |
| 4,479,987 | A | | 10/1984 | Koepke et al. |
| 4,510,882 | A | | 4/1985 | Prato |
| 4,558,657 | A | | 12/1985 | Rohrbach |
| 4,624,213 | A | | 11/1986 | Long et al. |
| 4,647,482 | A | | 3/1987 | Degrauwe et al. |
| 4,656,063 | A | | 4/1987 | Long et al. |
| 4,752,496 | A | | 6/1988 | Fellows et al. |
| 4,830,887 | A | | 5/1989 | Reiter |
| 4,922,851 | A | | 5/1990 | Morikawa et al. |
| 4,942,068 | A | | 7/1990 | Schweicher et al. |
| 4,944,960 | A | | 7/1990 | Sundholm et al. |
| 4,975,304 | A | | 12/1990 | Kawahara et al. |
| 5,224,996 | A | | 7/1993 | Ghys et al. |
| 5,236,744 | A | | 8/1993 | Suga et al. |
| 5,330,797 | A | | 7/1994 | Mues |
| 5,358,569 | A | | 10/1994 | Conroy et al. |
| 5,376,177 | A | | 12/1994 | Elvidge et al. |
| 5,393,571 | A | | 2/1995 | Suga et al. |
| 5,395,660 | A | | 3/1995 | Ruschak et al. |
| 5,399,385 | A | | 3/1995 | Joos et al. |
| 5,421,516 | A | | 6/1995 | Saitou et al. |
| 5,429,840 | A | * | 7/1995 | Raterman et al. ..... 427/256 |
| 5,505,995 | A | | 4/1996 | Leonard |
| 5,545,256 | A | | 8/1996 | Fukuda et al. |
| 5,654,040 | A | | 8/1997 | Matsunaga |
| 5,725,665 | A | | 3/1998 | Yapel et al. |
| 5,792,317 | A | | 8/1998 | Taylor et al. |
| 5,827,369 | A | | 10/1998 | Tobari et al. |
| 5,871,821 | A | | 2/1999 | Kondo et al. |
| 5,888,626 | A | * | 3/1999 | Sensenig ..... 428/206 |
| 5,906,865 | A | | 5/1999 | Ellermeier et al. |
| 5,985,030 | A | | 11/1999 | Taylor et al. |
| 6,040,016 | A | * | 3/2000 | Mitani et al. ..... 427/72 |
| 6,146,690 | A | | 11/2000 | Kustermann |
| 6,161,778 | A | * | 12/2000 | Haruch ..... 239/290 |
| 6,203,858 | B1 | | 3/2001 | Plomer |
| 6,217,940 | B1 | | 4/2001 | Kuni |
| 6,299,944 | B1 | | 10/2001 | Trapani |
| 6,346,299 | B1 | | 2/2002 | Gruszczynski, II et al. |
| 6,554,899 | B1 | | 4/2003 | Ogilvie, Jr. et al. |
| 2004/0062898 | A1 | * | 4/2004 | Felegi et al. ..... 428/44 |

OTHER PUBLICATIONS

"Liquid Film Disintegration Regimes and Proposed Correlations", I.S. Carvalho, M.V. Heitoyr and D. Santos. International Journal of Multiphase Flow (2002) 773-789.

"Atomization Performance of an Atomizer with Internal Impingement", Muh-Rong Wang, Tien-Chu Lin, teng-San Lai and Ing-Ren Tseng. JSME International Journal (2005), Series B, vol. 48, No. 4, 858-864.

"Disintegration of Liquid Sheets", A. Mansour and N. Chigier. Physics of Fluids A (1990), vol. 2 No. 5, 706-719.

"Experimental Investigation on Cellular Breakup of a Planar Liquid Sheet from an Air-Blast Nozzle", J. Park and K.Y. Huh. Physics of Fluids (2004), vol. 16 No. 3, 625-632.

* cited by examiner

COATING APPARATUS AND METHOD

FIELD OF THE INVENTION

The invention relates to a coating apparatus, and, more specifically, to an improved coating apparatus which provides a longitudinally extending, uniform, atomized coating stream.

BACKGROUND OF THE INVENTION

A critical issue for manufacturers of coating equipment is the need to meet customer demands for increased efficiencies in the coating application process. Regardless of the coating type or application methodology, uniformity of application and transfer efficiency are critical parameters that continue to be addressed by research and development efforts.

Selection of the appropriate application methodology depends not only on the type of coating but also on the requirements of the substrate to which it is applied.

For example, where the acoustical capabilities of an object are sought to be maintained, it is widely known in the coatings art that it is critical for the coating to have little or no impact on acoustical performance of the material, i.e. the coating is acoustically transparent. It is also widely known that the acoustical performance of a material is impacted by both the uniformity of application as well as the thickness of the coating. Thus, obtaining the optimal performance of a material, such as an acoustical fibrous mat, requires a minimum deviation of acoustic capability across the entire surface of the material.

One well known large-scale, i.e. industrial-scale, atomization technique which provides acoustical transparency and wide-area coverage is illustrated in prior art FIG. 1. This conventional large-scale coating technique utilizes a series of single-point atomizing spray guns, or nozzles. This system is commonly known in the industry as an overlap, or multi-tip header. As shown in FIG. 1, each nozzle 1A-1E, commonly referred to in the art as a single-point nozzle, produces an atomized fluid stream, 3A-3E respectively, which spreads out, or diverges, into a conical spray pattern. To ensure complete coverage across a large width, the outer portions of the atomized fluid streams 3A-3A must overlap. Though undetectable to the naked eye, these overlapping streams do not uniformly apply the coating.

To approach uniformity of application using overlap header technology, several features can be manipulated, including: the spacing of the nozzles; the spacing between the overlap header and the object to be coated; the tip geometry of the nozzles; and the flow rate of the fluid passing through the nozzles. However, it is widely known and understood by those of ordinary skill in the art that overlap header technology assumes a density gradient for each nozzle, and, thus, the effort to approach uniformity of application is an iterative process that is fundamentally variable.

One skilled in the art further understands that it is impossible to completely eliminate defects such as streaks and shade variation using an overlap header. A conventional attempt to randomize these defects is to use cyclically traversing, i.e. reciprocating, multi-tip headers instead of multi-tip fixed headers. Conventional wisdom is that randomizing these defects will in effect disguise the defects and make them undetectable to the naked eye.

Unfortunately, both fixed and reciprocation headers add cost to the final product. For example, as the tip of each gun gradually wears or even becomes clogged, the spray pattern of the gun will change and ultimately lead to a more non-uniform application. Also, frequent interruptions due to cleaning or replacement of the tips adds considerable expense in terms of the downtime required and the cost of the replacement part. Thus, an alternative large-scale technique which addresses the issues with existing techniques is needed.

SUMMARY

The present invention is an industrial-scale coating apparatus for applying a liquid coating to the surface of a sound absorbing material. The apparatus includes a longitudinally extending discharge nozzle having a specified length. The nozzle discharges a linear stream of atomized droplets at a uniform velocity along the entire specified length of the nozzle.

The present invention further includes an improved methodology of spray coating a moving object on an industrial scale. The method includes the steps of: (a) providing an industrial-scale coating apparatus having a longitudinally extending discharge nozzle having a specified length; (b) positioning the coating apparatus above a conveyor, the conveyor having a direction of travel such that the longitudinally extending discharge nozzle extends in a direction transverse the direction of travel of a conveyor; and (c) discharging a linear stream of atomized droplets onto the surface of an object moving on the conveyor, the linear stream of atomized droplets being discharged from the nozzle at a uniform velocity along the entire specified length of the nozzle.

The improved coating apparatus and spray coating methodology are particularly useful in applying a liquid coating to the surface of a material that requires a minimum deviation in acoustic capability across the entire surface of the material for optimum performance. The apparatus and methodology are also useful when a minimal deviation of one or more of light reflectance, color, and gloss capability of the material is desired. Additional advantages include, but are not limited to: the elimination of visual defects created by multiple atomizing streams; the elimination of the use of a multiple atomizing streams utilizing the technique of reciprocation to randomize visual defects; and the elimination of the cost of and the maintenance of multiple, single-point atomizing spray nozzles.

DETAILED DESCRIPTION OF THE DRAWINGS

Figure 1:
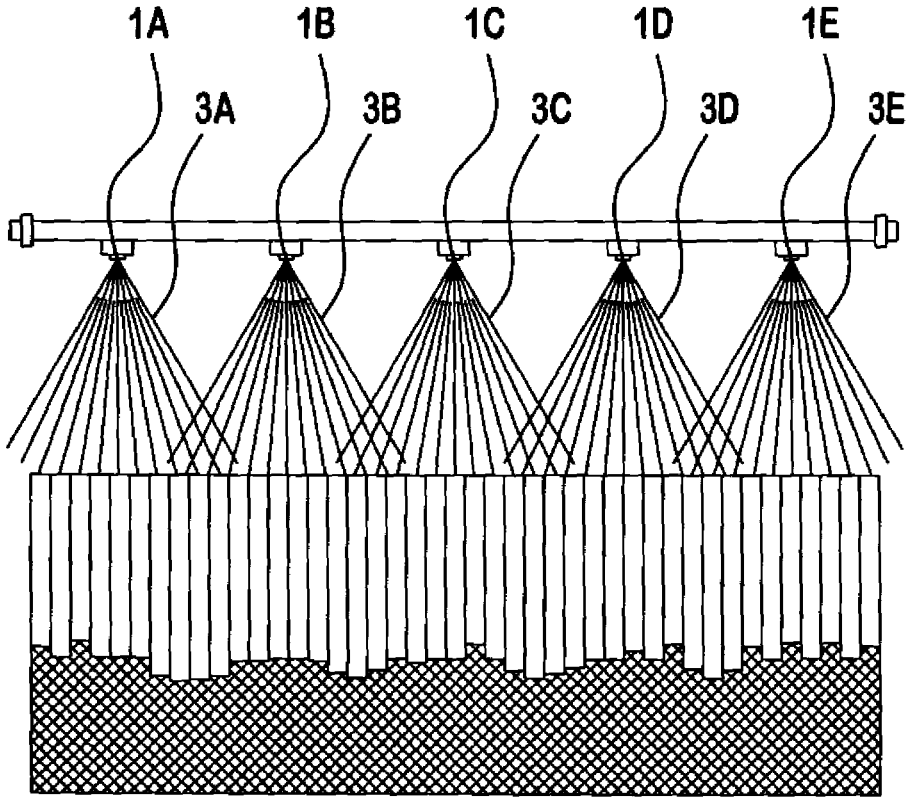
FIGURE 1 (PRIOR ART)
FIG. 1 is an elevation view of a prior art coating apparatus utilizing multiple single-point atomizing spray nozzles.
Figure 2:
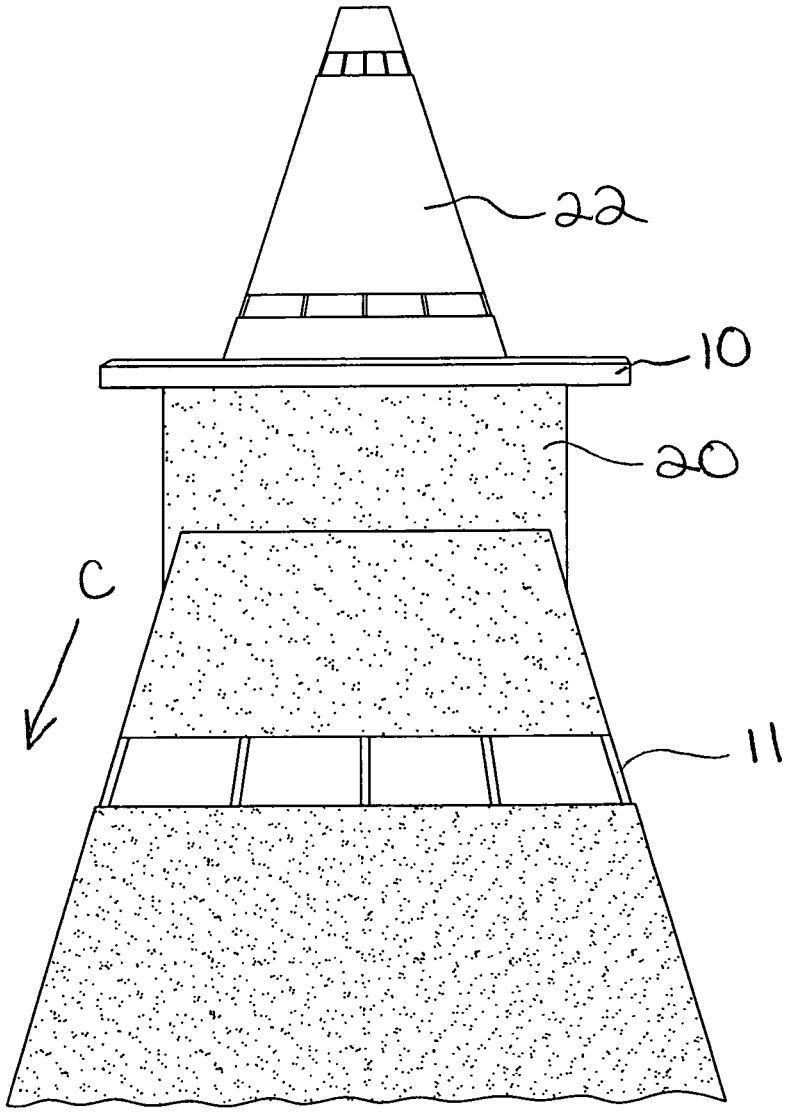
FIG. 2 is a perspective view of a portion of a coating system utilizing the coating apparatus of the invention.

Reference is now made to the drawings wherein similar components bear the same reference numerals throughout the several views.

The improved atomizing apparatus can be utilized in conventional industrial-scale coating systems, including systems having a longitudinally extending conveyor which transports the object or material to be coated through a coating station such as illustrated in FIG. 1. As shown, the atomizing apparatus 10 is positioned above a conveyor 11, or backing roller, in spaced relation, thereby forming a "coating zone". The conveyor 11 has a direction of travel indicated by Arrow C. The apparatus 10 is positioned in a direction transverse to the direction of travel of the conveyor 11. As shown, an uninterrupted stream of atomized coating material 20 is discharged onto the surface of an object 22, such as an acoustical ceiling tile, at an application rate that is uniform across the entire length of the discharge nozzle 16, and, in turn, the entire length of the object 22.

Figure 3:
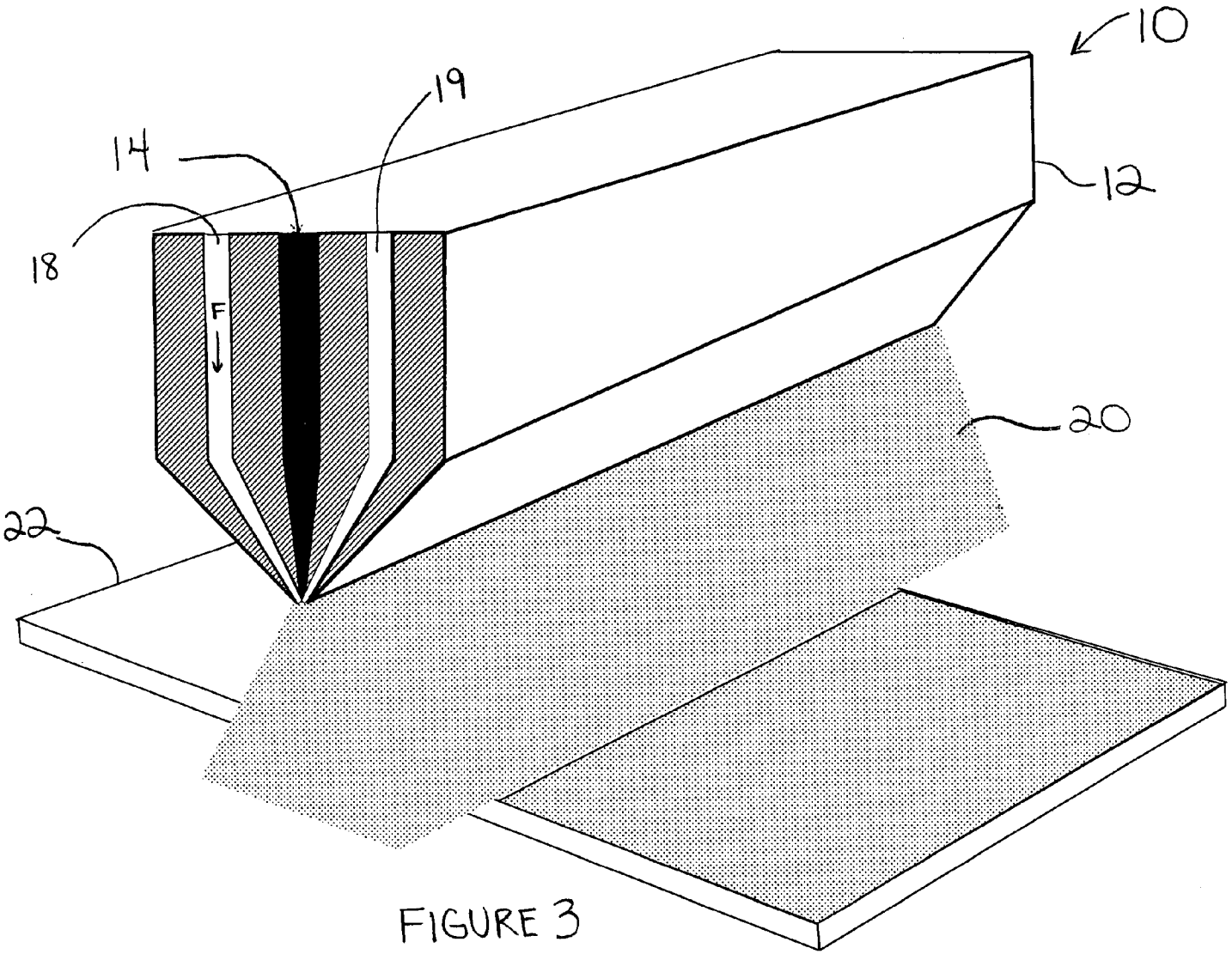
FIG. 3 is a perspective view in partial cross-section of an example embodiment of the coating apparatus of the invention.
Figure 4:
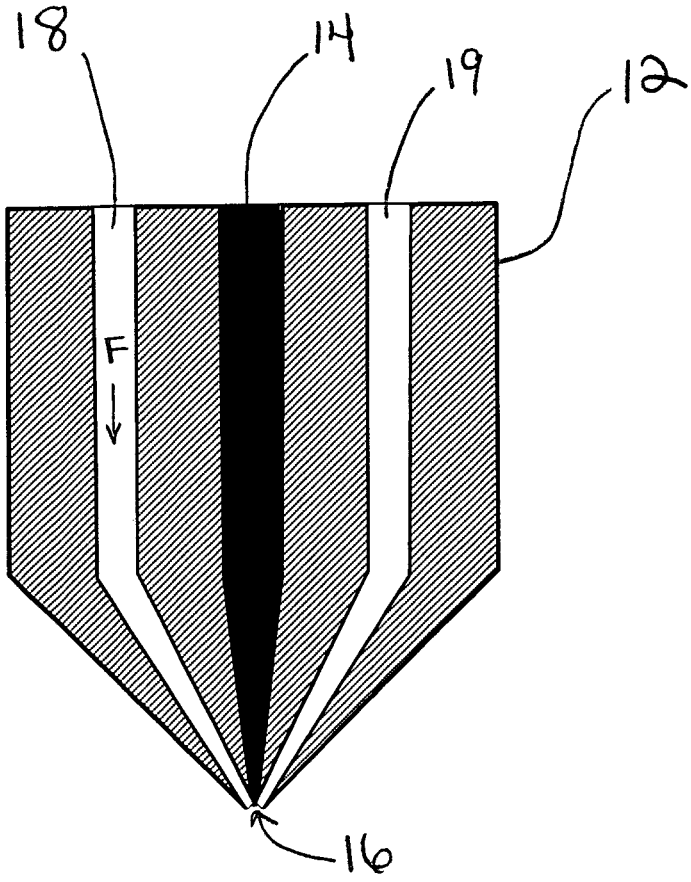
FIG. 4 is a cross sectional view of the example embodiment illustrated in FIG. 3.

FIGS. 3 and 4 illustrate a first example embodiment of the improved industrial size coating apparatus 10 in greater detail. The coating apparatus 10 includes a generally linear, longitudinally extending housing structure 12. The housing structure 12 includes a hopper 14, which houses liquid coating material. The liquid coating material typically used to coat materials on an industrial-sized scale, such as liquid coating material for acoustical ceiling tiles, includes about 40% to about 70% solids by weight, and preferably from about 50% to about 60% solids by weight.

In the embodiments shown throughout the drawings, the hopper 14 extends longitudinally and substantially the entire length of the housing structure 12. As best seen in FIG. 4, at the base of the hopper 14 is a linear discharge nozzle 16 which, although not required, may also extend substantially the entire length of the housing structure 12. Typically, the liquid coating material is permitted to flow from the hopper 14 and through the linear discharge nozzle 16 by gravity.

The housing structure 12 further includes a first air stream 18 and a second air stream 19. Both air streams 18, 19 extend in the longitudinal direction and are positioned in parallel relation with the linear discharge nozzle 16. The outlets of the air streams 18, 19 are positioned proximate the linear discharge nozzle 16. High velocity air flows through the air streams as illustrated by arrow F, and ultimately impinges on the liquid coating material as the fluid exits the linear discharge nozzle 16. Preferably, the air stream outlets are positioned behind, e.g. above, the outlet of the discharge nozzle so that the high velocity air causes the liquid coating to rush toward the object to be coated as an uninterrupted, uniform, longitudinally extending stream of atomized fluid droplets 20 having a longitudinally extending fan radius. By way of comparison, when a stream of air impinges on the coating stream in a conventional atomization spray apparatus, such as atomization spray apparatus illustrated in FIG. 1, the atomized droplets form a circular fan radius.

Figure 5:
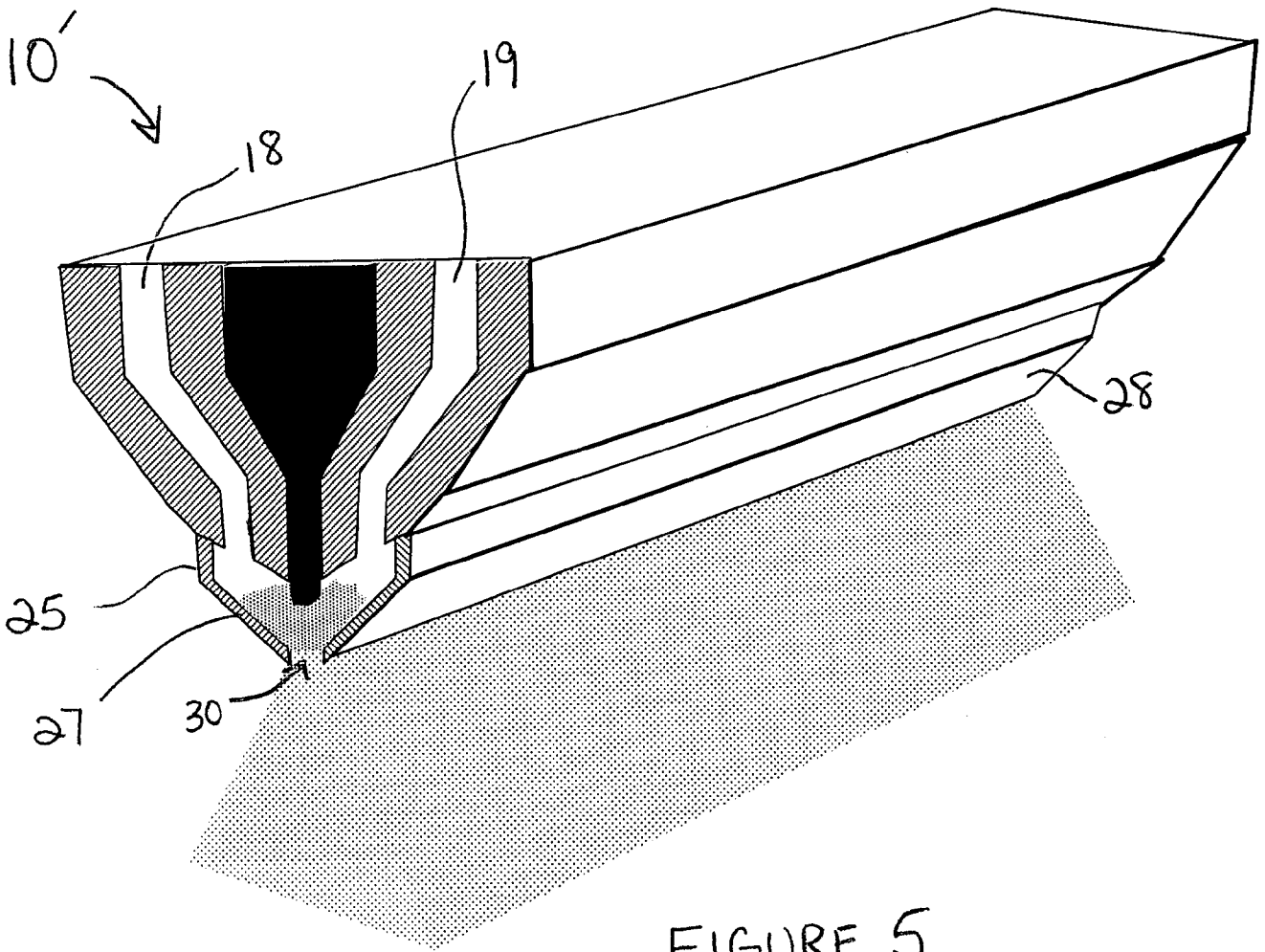
FIG. 5 is a perspective view in partial cross-section of a second example embodiment of the coating apparatus of the invention.
Figure 6:
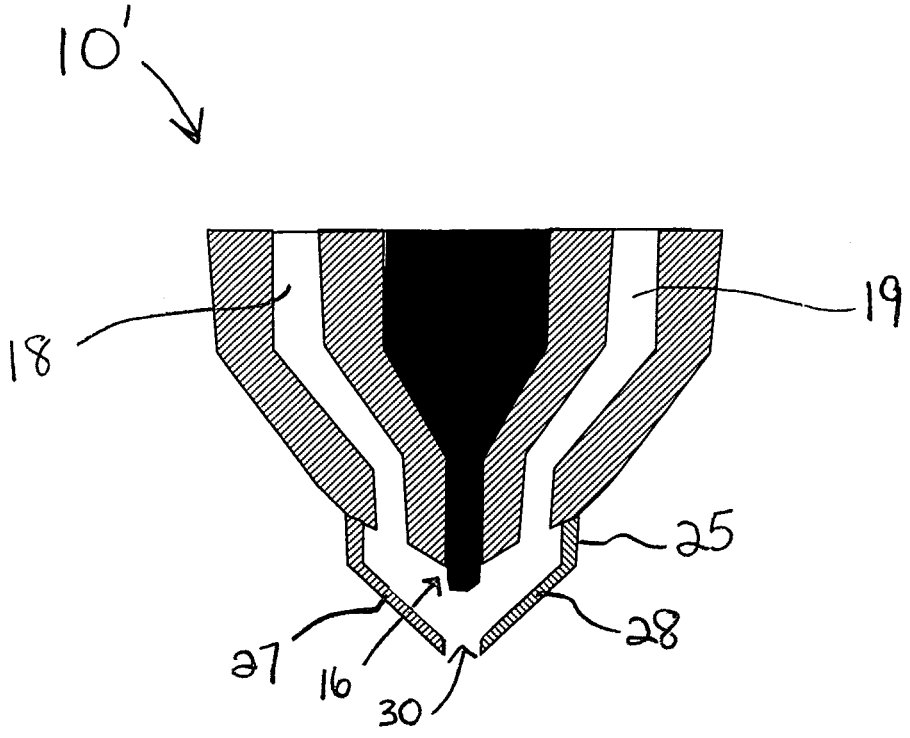
FIG. 6 is a cross sectional view of the example embodiment illustrated in FIG. 5.

FIGS. 5 and 6 illustrate a second example embodiment of the coating apparatus of the invention. The second example embodiment includes all of the features described above with respect to the first example embodiment. In addition, at the base of this coating apparatus 10' is a cap 25 which provides an area for internal mixing of the air and liquid coating prior to exiting the apparatus 10. For purposes of this description, internal air mixing is defined as a fluid stream being mixed within the confines of the coating apparatus. The cap 25 includes first and second side walls, 27 and 28 respectively. At least a portion of each sidewall 27, 28 is disposed at an angle so as to form a linear opening 32 therebetween. The linear cap opening 32 is preferably in alignment with the linear discharge nozzle 16. Furthermore, the length of the linear cap opening 32 is preferably substantially the same length as the longitudinally extending linear nozzle 16 and air streams 18, 19.

The above description of the invention is provided as an enabling teaching of the invention in its best, currently known embodiment. It will be understood by those of skill in the art that variations on the embodiments set forth herein are possible and within the scope of the present invention. The embodiments set forth above and many other additions, deletions, and modifications may be made by those of skill in the art without departing from the spirit and scope of the invention.

For example, the apparatus 10, 10' may also utilize external air assistance. For purposes of this description, "external air assistance" means that the air is added by means of an air stream outside the components of the coating apparatus such as air generated via linear air knives or jets which are known in the art. External air assistance will further atomize the stream of atomized fluid droplets and maintain uniformity. Depending on the angle on impingement, the external air assistance may increase the speed of the droplets 20 towards the spray target.

I claim:

1. An industrial-scale atomizing apparatus for applying a liquid coating, the apparatus comprising:

a hopper containing the liquid coating;

a discharge nozzle having an elongated slot outlet having a length that extends along a longitudinal axis, the discharge nozzle fluidly coupled to the hopper so that the liquid coating flows from the hopper and through the elongated slot outlet by gravity;

a first air stream having an elongated slot outlet that extends substantially parallel to the elongated slot outlet of the discharge nozzle;

a second air stream having an elongated slot outlet that extends substantially parallel to the elongated slot outlet of the discharge nozzle, the first and second air streams positioned proximate the discharge nozzle;

the elongated slot outlets of the first and second air streams positioned above the elongated slot outlet, wherein the elongated slot outlet of the discharge nozzle discharges a liquid stream of atomized droplets of the liquid coating at a substantially uniform velocity along the length of the elongated slot outlet of the discharge nozzle in a longitudinally extending fan pattern; and wherein the first air stream is isolated from the liquid coating prior to exiting the elongated slot outlet of the first air stream, and the second air stream is isolated from the liquid coating prior to exiting the elongated slot outlet of the second air stream;

wherein each of the first and second air streams extend longitudinally and in parallel relation to the discharge nozzle.

2. The industrial-scale atomizing apparatus of claim 1, wherein the liquid coating comprises from about 40% to about 70% solids by weight.

3. The industrial-scale atomizing apparatus of claim 2, wherein the liquid coating comprises from about 50% to about 60% solids by weight.

4. The industrial-scale atomizing apparatus of claim 1, whereby a minimum deviation is achieved in acoustic capability of an acoustical material to which the liquid coating is applied.

5. The industrial-scale atomizing apparatus of claim 1, whereby the apparatus provides a coating which has minimal impact on the light reflectance, color, and gloss of the material to which the coating is applied.

* * * * *